US007305908B2

(12) United States Patent
Chi

(10) Patent No.: US 7,305,908 B2
(45) Date of Patent: Dec. 11, 2007

(54) EASY STORAGE PRECISION SCREWDRIVER

(76) Inventor: Li-Lien Chi, No. 70, Datong 6th St., Wurih Township, Taichung County 414 (TW)

( * ) Notice: Subject to any disclaimer, the term of this patent is extended or adjusted under 35 U.S.C. 154(b) by 0 days.

(21) Appl. No.: 11/557,232

(22) Filed: Nov. 7, 2006

(65) Prior Publication Data

US 2007/0227312 A1 Oct. 4, 2007

(51) Int. Cl.
*B25B 23/16* (2006.01)
*B25B 15/00* (2006.01)

(52) U.S. Cl. ..... 81/177.4; 81/490

(58) Field of Classification Search ..... 81/436, 81/438–439, 177.4, 490–492, 177.2
See application file for complete search history.

(56) References Cited

U.S. PATENT DOCUMENTS 6,508,156 B1 * 1/2003 Wei ..... 81/490
6,997,088 B2 * 2/2006 Hu ..... 81/490
7,021,181 B1 * 4/2006 Chi ..... 81/490
7,039,975 B1 * 5/2006 Liao ..... 7/165

* cited by examiner

*Primary Examiner*—D. S. Meislin
(74) *Attorney, Agent, or Firm*—Banger Shia

(57) ABSTRACT

An easy storage precision screwdriver comprises a handle, a cover disposed on one end of the handle, a post disposed on the cover and located in the handle, a pressing ring threaded on the other end of the handle, and a working post inserted into the handle and fixed by the pressing of the pressing ring. Since the handle and the post are defined with a containing hole and a through hole respectively, when the user releases the pressing ring, the length of the working post with respect to the handle can be adjusted, and one end of the working post can be inserted into the containing hole and the through hole of the handle and the post. Thereby the precision screwdriver of the present invention is miniaturized, and is easy to store.

4 Claims, 8 Drawing Sheets

EASY STORAGE PRECISION SCREWDRIVER

BACKGROUND OF THE INVENTION

1. Field of the Invention

The present invention relates to a precision screwdriver, and more particularly to an easy storage precision screwdriver.

2. Description of the Prior Art

Hand tools are widely used in assembling, disassembling and repairing the goods; as a result, one of the hand tools, a precision screwdriver, has become an indispensable tool.

A pen-shaped precision screwdriver disclosed in Taiwan Pat. No. 092206211 comprises a handle, a clipping member, a top cover, a screwdriver post and a screwdriver head. The screwdriver head can be replaced flexibly, and its double heads can be interchangeably inserted into the handle, so that the screwdriver head can be replaced without much trouble.

The above-mentioned precision screwdriver comes with the advantage of easy replacing of screwdriver heads to suit the needs of a user. On the other hand, a major drawback of such a structure is that when one end of the screwdriver post is inserted into the handle, and the other end of the screwdriver post is extended outward, the total length of the screwdriver head is increased. As a result, when the precision screwdriver is stored in a pocket or a toolbox, the screwdriver will occupy more space.

The present invention has arisen to mitigate and/or obviate the afore-described disadvantages.

SUMMARY OF THE INVENTION

The primary objective of the present invention is to provide a precision screwdriver which has a compact structure for operation and storage purpose.

The easy storage precision screwdriver of the present invention comprises a handle, a cover disposed on one end of the handle, a post disposed on the cover and located in the handle, a pressing ring threaded on the other end of the handle, and a working post inserted into the handle and fixed by the pressing of the pressing ring.

Since the handle and the post are defined with a containing hole and a through hole respectively, when the user releases the pressing ring, the length of the working post with respect to the handle can be adjusted accordingly, and one end of the working post can be inserted into the containing hole and the through hole of the handle and the post. Therefore, the size of the precision screwdriver of the present invention is miniaturized.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
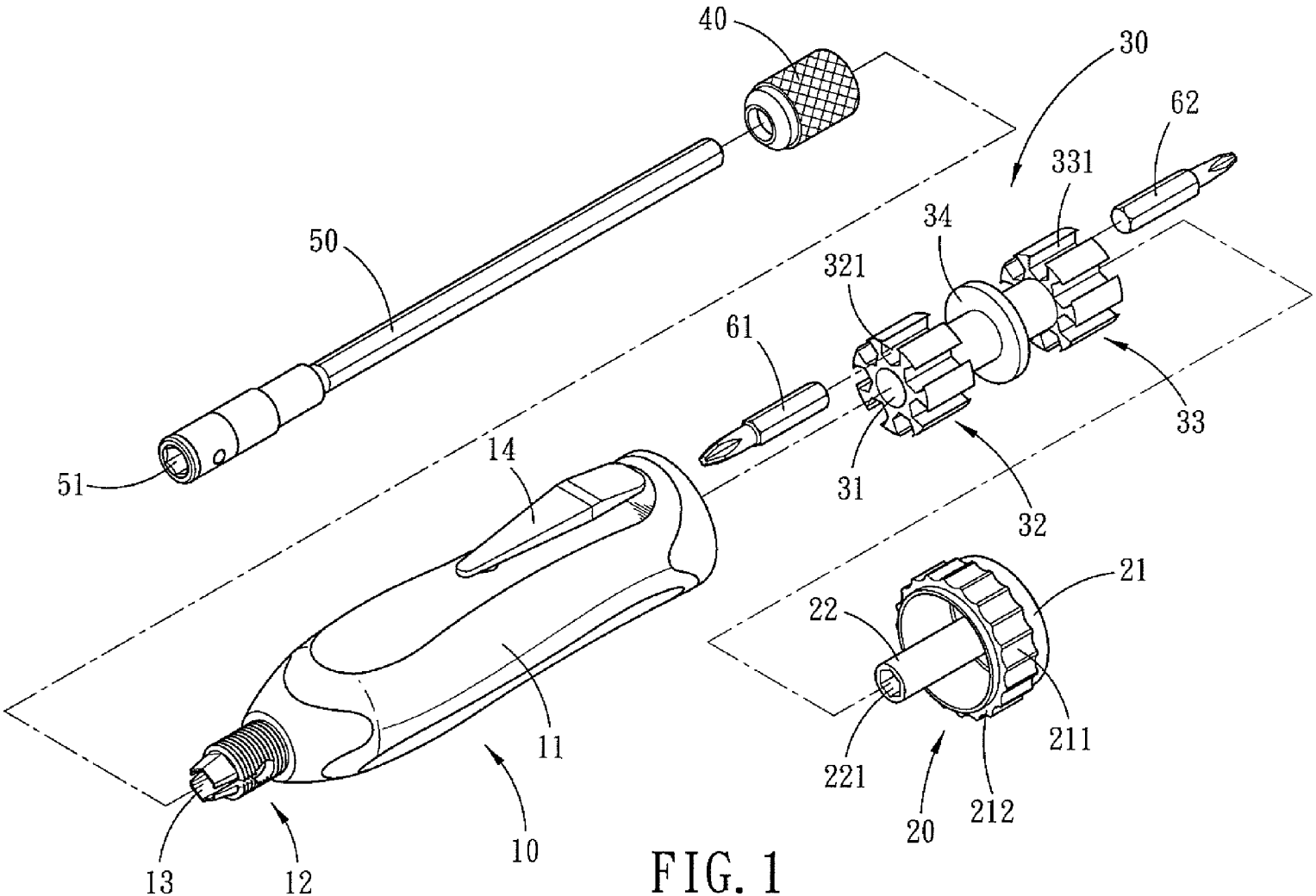
FIG. 1 is an exploded view of an easy storage precision screwdriver in accordance with the present invention.
Figure 2:
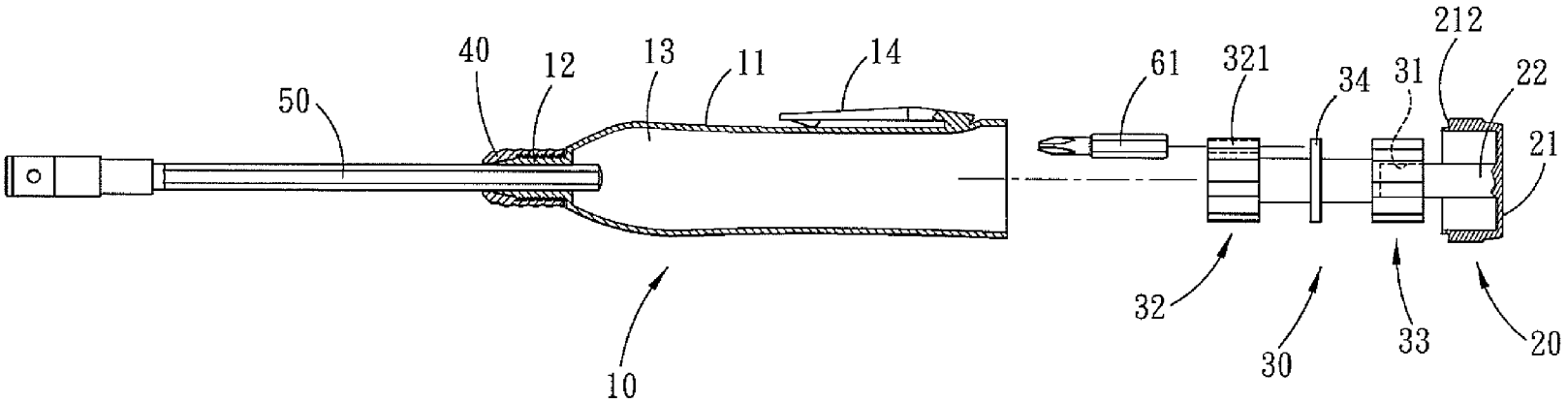
FIG. 2 is a partial cross sectional view of the easy storage precision screwdriver in accordance with the present invention.

Referring to FIGS. 1 and 2, an easy storage precision screwdriver in accordance with the present invention comprises a handle 10, a cover 20, a post 30, a pressing ring 40 and a working post 50.

The handle 10 includes a handle section 11 and a clipping section 12 that is integrally formed on one end of the handle section 11. The handle 10 is defined with a containing hole 13 that penetrates the handle section 11 and the clipping section 12, the end of the containing hole 13 located at the clipping section is hexagonal-shaped, and a clipping piece 14 is integrally formed on the handle section 11 of the handle 10.

The cover 20 includes an annular mask 21 for covering the end of the handle section 11 and a connecting post 22 that is integrally formed on the mask 21. The connecting post 22 is defined with a hexagonal hole 221. In a periphery of the mask 21 is integrally formed a continuous concave and convex anti-sliding structure 211. One end of the mask 21 is formed with a stepping edge 212 that is engaged with the end of the containing hole 13 of the handle section 11 of the handle 10, and the connecting post 22 of the cover 20 is inserted into the containing hole 13.

The post 30 is axially formed with a through hole 31 for fixing the post 30 to the connecting post 22 of the cover 20, and the post 30 is located in the containing hole 13 of the handle 10. Both ends of the post 30 is formed with a first clipping area 32 and a second clipping area 33 respectively, and the first clipping area 32 and the second clipping area 33 are formed with seven clipping grooves 321 and 331 that are arranged in an annular fashion and are provided for fixing screwdriver heads 61 and 62 with single head, respectively. In addition, the post 30 is radially formed with a circular stopping piece 34 that is located between the first clipping area 32 and the second clipping area 33.

The pressing ring 40 is threaded on the clipping section 12 of the handle 10.

The working post 50, one end of the working post 50 is inserted into the containing hole 13 of the handle 10, and the other end of the working post 50 is defined with a hexagonal installing groove 51 for connecting to the screwdriver heads 61 and 62.

Figure 3:
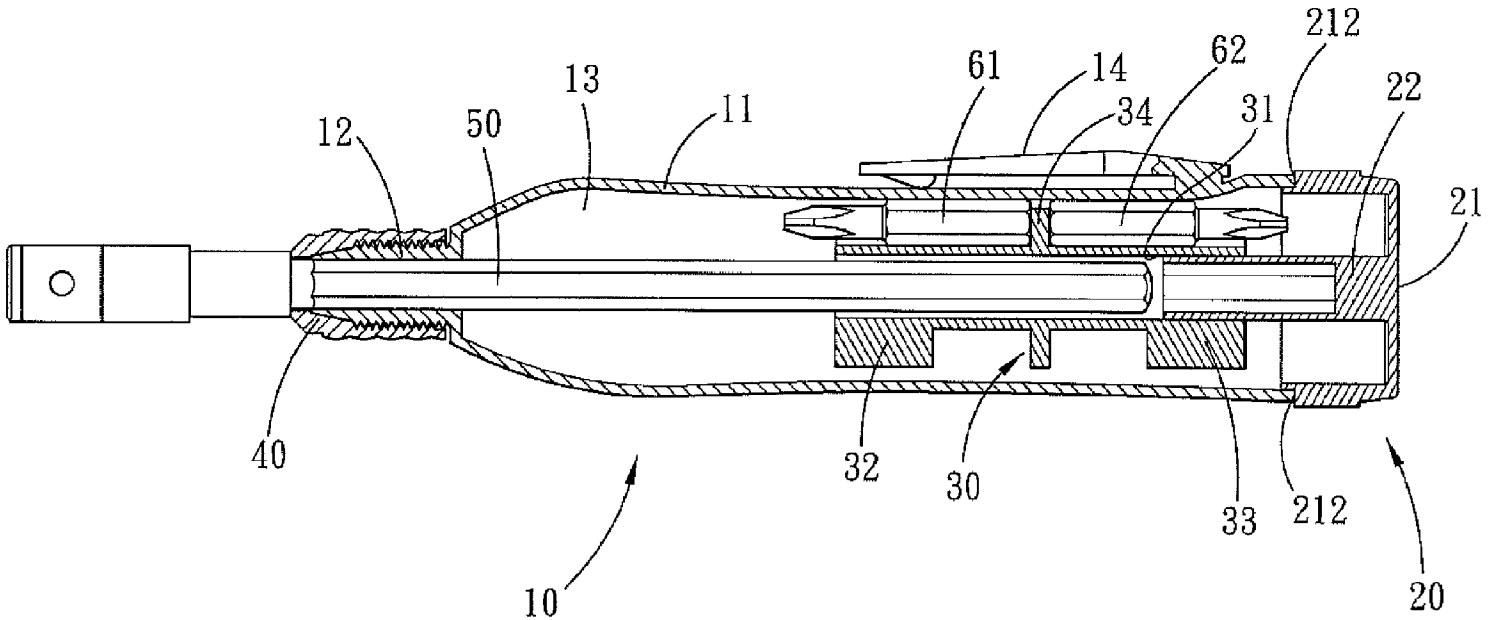
FIG. 3 is an assembly cross sectional view of the easy storage precision screwdriver in accordance with the present invention.
Figure 4:
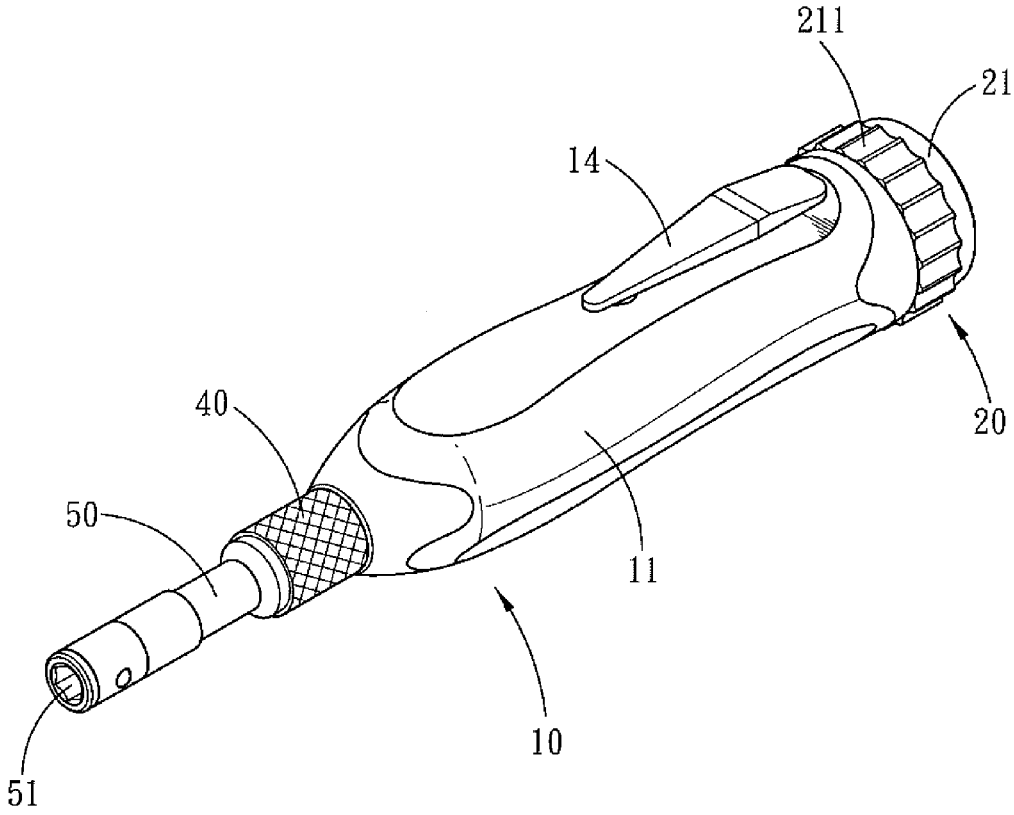
FIG. 4 is a perspective view of the easy storage precision screwdriver in accordance with the present invention.

Referring further to FIGS. 2-4, when the user wants to store the precision screwdriver, the user can adjust the pressing ring 40, releasing it from the clipping section 12 of the handle 10 so as to adjust the length of the working post 50 with respect to the handle 10. Or, one end of the working post 50 can be inserted into the containing hole 13 of the handle 10 and the through hole 31 of the post 30, so that most part of the working post 50 is located in the handle 10. By such arrangements, the precision screwdriver of the present invention is miniaturized and is easy to store.

When the user wants to use the screwdriver head 61 fixed to the post 30, the user can pull the cover 20 covering the end of the handle section 11 of the handle 10, so that the post 30 will be separated from the handle 10 driven by the cover 20. And the user can extract the screwdriver head 61 along the axis of the post 30, and then insert one end of the screwdriver head 61 into the installing groove 51 of the working post 50.

In addition, since the stopping piece 34 of the post 30 is located between the first clipping area 32 and the second clipping area 33, the screwdriver heads 61 and 62 can be fixed in the clipping grooves 321 and 331 respectively as shown in FIG. 3.

Figure 5:
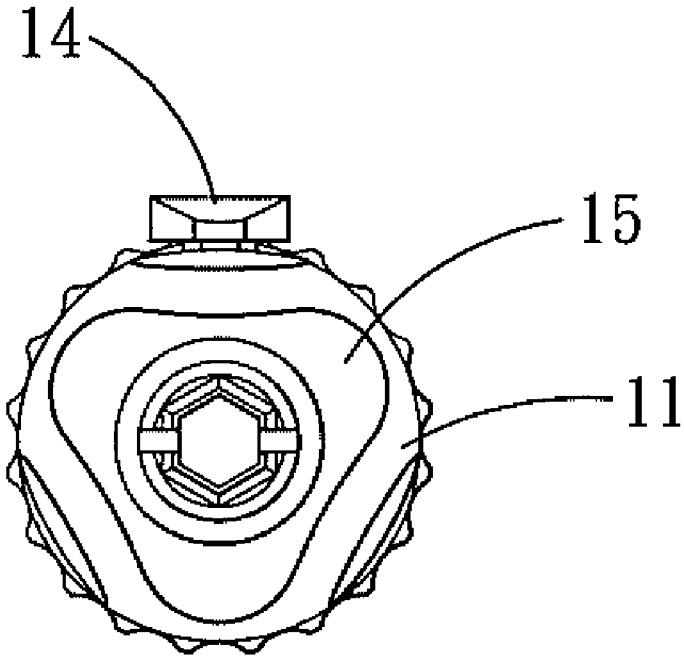
FIG. 5 is a side view of the easy storage precision screwdriver in accordance with the present invention.

With reference to FIG. 5, it is to be noted that the jointing portion between the handle section 11 of the handle 10 and the clipping section 12 is a tapered structure with three sides defining a gripping surface 15.

Figure 6:
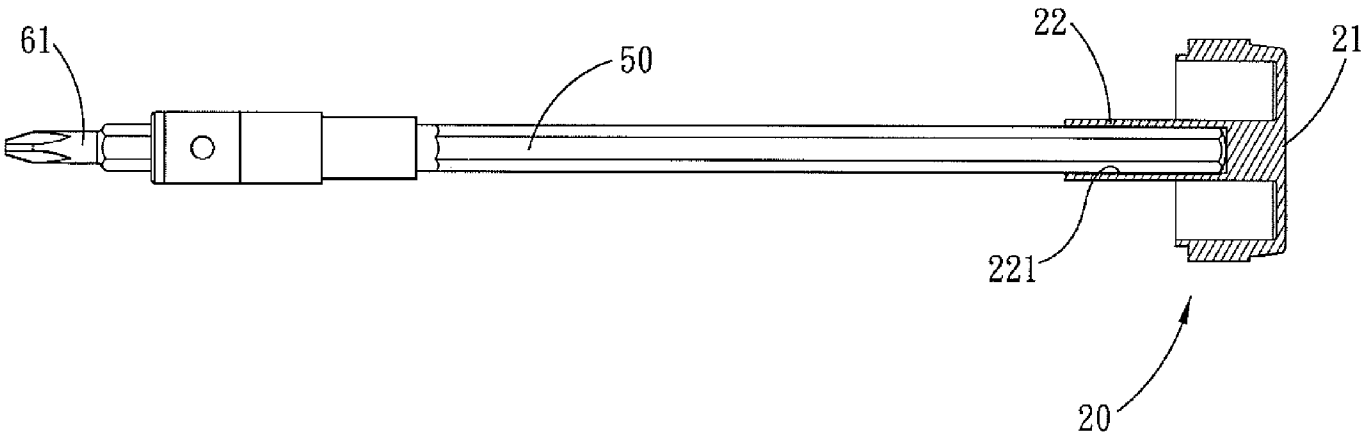
FIG. 6 is a perspective view of showing a working post being inserted into a cover.

Referring further to FIG. 6, the hexagonal hole 221 of the connecting post 22 of the cover 20 is provided for insertion of one end of the working post 50, so that the cover 20 of the present invention can operate the screwdriver head 61 separately by cooperating with the working post 50.

Figure 7:
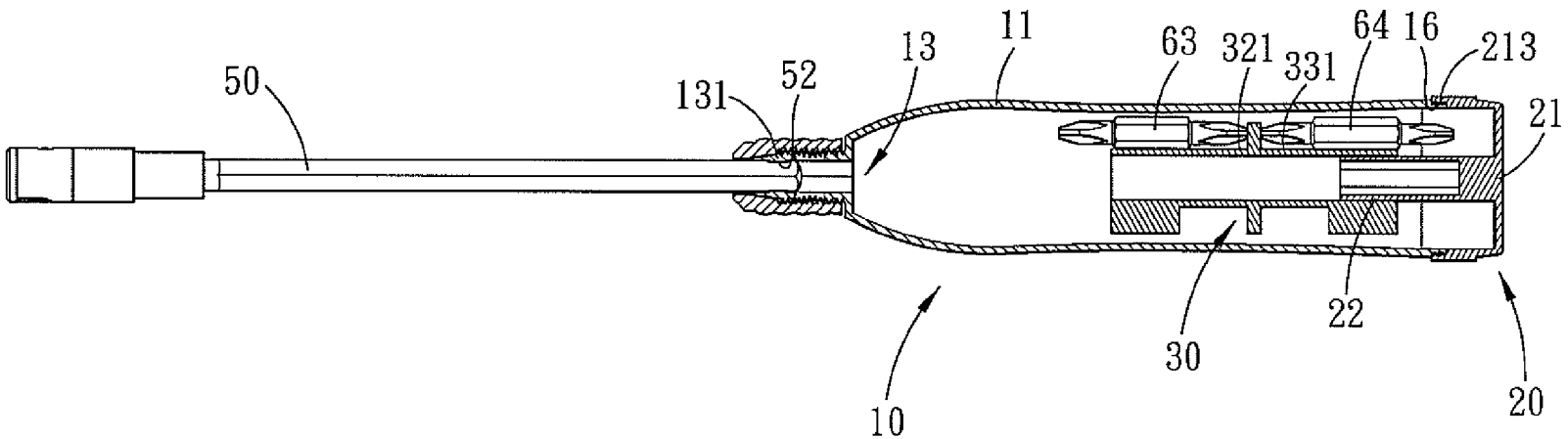
FIG. 7 is another perspective view of the easy storage precision screwdriver in accordance with the present invention.

When assembling the cover 20 with the handle 10, in addition that the stepping edge 212 of the cover 20 is engaged with the end of the containing hole 13 of the handle section 11 of the handle 10, the cover 20 also can be threaded with the handle 10 as shown in FIG. 7:

One end of the mask 21 of the cover 20 is formed with inner threads 213, and the handle section 11 of the handle 10 is formed with outer threads 16 that are threaded with the inner threads 213 of the mask 21.

Furthermore, in order to increase the jointing strength of the working post 50 and the handle 10 when operating, since the end of the containing hole 13 of the clipping section 12 of the handle 10 is formed with protruded points 131, and the working post 50 is formed with grooves 52, when the working post 50 is inserted into the end of the containing hole 13 of the clipping section 12 of the handle 10, the protruded points 131 of the handle 10 are engaged in the grooves 52 of the working post 50, thus increasing the jointing strength of the working post 50 and the handle 10. And the clipping grooves 321 and 331 of the post 30 can be provided for fixing screwdriver heads 63 and 64 with double heads respectively.

Figure 8:
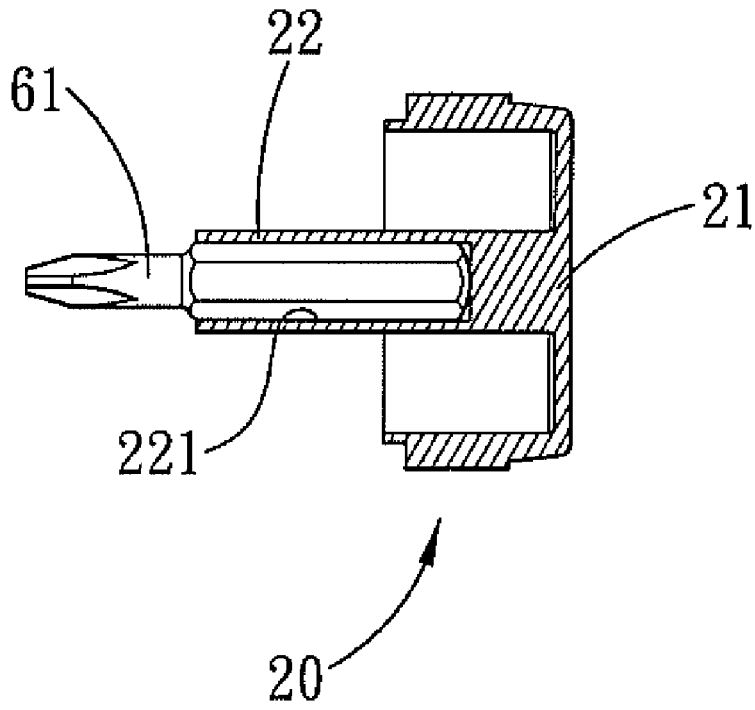
FIG. 8 is a further perspective view of the easy storage precision screwdriver in accordance with the present invention.

In addition that the hexagonal hole 221 of the connecting post 22 of the cover 20 is provided for insertion of the working post 50 to operate the screwdriver head 61 (as shown in FIG. 6), the hexagonal hole 221 of the connecting post 22 of the cover 20 also can be provided for operating the screwdriver head 61 directly after being inserted (as shown in FIG. 8).

While we have shown and described various embodiments in accordance with the present invention, it should be clear to those skilled in the art that further embodiments may be made without departing from the scope of the present invention.

What is claimed is:

1. An easy storage precision screwdriver, comprising:

a handle having a handle section and a clipping section integrally formed on one end of the handle section, the handle being defined with a containing hole penetrating the handle section and the clipping section, and a clipping piece being integrally formed on the handle section of the handle;

a cover being disposed on the end of the handle section of the handle and having an annular mask for covering the end of the handle section and a connecting post integrally formed on the mask, and the connecting post of the cover being inserted into the containing hole of the handle section of the handle;

a post being axially formed with a through hole for fixing the post to the connecting post of the cover, the post being located in the containing hole of the handle, both ends of the post being formed with a first clipping area and a second clipping area respectively, and the post being radially formed with a circular stopping piece that is located between the first clipping area and the second clipping area;

a pressing ring threaded on the clipping section of the handle;

a working post inserted into the containing hole of the handle, by releasing the pressing ring, one end of the working post being allowed to be inserted into the containing hole of the handle, and the working post being allowed to be inserted into the through hole of the post.

2. The easy storage precision screwdriver as claimed in claim 1, further comprising a continuous concave and convex anti-sliding structure that is integrally formed in a periphery of the mask of the cover.

3. The easy storage precision screwdriver as claimed in claim 1, wherein the first clipping area and the second clipping area are formed with a plurality of clipping grooves, the clipping grooves are arranged in an annular fashion and are provided for fixing screwdriver heads respectively.

4. The easy storage precision screwdriver as claimed in claim 1, wherein a jointing portion between the handle section of the handle and the clipping section is a tapered structure with three sides defining a gripping surface.

* * * * *